United States Patent [19]

Hashimoto et al.

[11] Patent Number: 4,979,839

[45] Date of Patent: Dec. 25, 1990

[54] MECHANICAL PENCIL HAVING AN AUTOMATIC LEAD EXTENDING MECHANISM

[75] Inventors: Yasuyuki Hashimoto; Haruo Yamashita, both of Hyogo, Japan

[73] Assignee: Ancos Co., Ltd., Osaka, Japan

[21] Appl. No.: 318,300

[22] Filed: Mar. 3, 1989

[30] Foreign Application Priority Data

Jul. 30, 1988 [JP] Japan ..... 63-191074

[51] Int. Cl.[5] ..... B43K 21/22; B43K 24/10

[52] U.S. Cl. ..... 401/65; 401/67; 401/82; 401/94

[58] Field of Search ..... 401/67, 99, 65, 93, 401/82, 94

[56] References Cited

U.S. PATENT DOCUMENTS

| | | | |
|---|---|---|---|
| 2,340,665 | 2/1944 | Jacobs | 401/65 |
| 3,836,264 | 9/1974 | Saito | 401/92 |
| 3,854,824 | 12/1974 | Kamo | 401/65 |
| 3,883,253 | 5/1975 | Naruse | 401/92 |
| 3,892,495 | 7/1975 | Naruse | 401/93 |
| 4,269,524 | 5/1981 | Hashimoto | 401/67 |
| 4,270,870 | 6/1981 | Hashimoto | 401/93 |
| 4,358,210 | 11/1982 | Hashimoto | 401/80 |

FOREIGN PATENT DOCUMENTS

| | | | |
|---|---|---|---|
| 1020256 | 11/1957 | Fed. Rep. of Germany | 401/99 |

*Primary Examiner*—Richard J. Johnson

*Attorney, Agent, or Firm*—Sughrue, Mion, Zinn, Macpeak & Seas

[57] ABSTRACT

A mechanical pencil having an automatic lead extending mechanism which has a radially displaceable member disposed on an entire circumference of the pencil body. The lead protrudes from a tip end of the pencil body when the radially displaceable member is radially displaced.

25 Claims, 12 Drawing Sheets

MECHANICAL PENCIL HAVING AN AUTOMATIC LEAD EXTENDING MECHANISM

BACKGROUND OF THE INVENTION

The present invention relates to a mechanical pencil, and more particularly to a mechanical pencil having an automatic lead extending mechanism in which the lead is extended, clamped and released merely by controlling (or increasing and decreasing) a pinching force applied to the pencil body.

According to the conventional mechanical pencil, when the lead is worn out during writing, it is extended by a turn system in which the mechanical pencil body is turned, a knock system in which the mechanical pencil body is knocked on the top, a side knock system in which the side button of the mechanical pencil body is pushed, a system of turning an end portion of the pencil body, or a system of pulling an end ring of the mechanical pencil body, or a system of pulling the end ring of the pencil body. However, these conventional systems are disadvantageous in that, before the lead is extended, the mechanical pencil body must be held again, or the fingers holding the body must be shifted; that is, the lead cannot be extended without such a troublesome operation.

On the other hand, the lead can be extended with the fingers holding the mechanical pencil body maintained unchanged in position according to the following systems: a tip knock system in which a tip end of the mechanical pencil is pushed against a writing sheet or the like, a shake system in which the mechanical pencil is strongly shaken up and down, and a bend system in which the mechanical pencil is bent in the form of the character "L". However, these systems in which it is unnecessary to shift the fingers holding the mechanical pencil to extend the lead are still disadvantageous in that, since it is necessary to shake the mechanical pencil with the wrist held above the writing sheet or to push the top of the mechanical pencil body against the writing sheet, the writing sheet may be become dirty or damaged, or abnormal force may be applied to the mechanical pencil to break or bend the latter.

In order to eliminate the above-described difficulties, a so-called "automatic lead extending type mechanical pencil" has been developed by the present inventors. In the mechanical pencil thus developed, a ball is interposed between the chuck and the tightening member; that is, the mechanical pencil of such a type is intricate in construction and must be manufactured with high accuracy. Therefore, it is disadvantageous in that it would require high manufacturing cost and is liable to malfunction. In addition, it suffers from difficulties that it is necessary to knock the mechanical pencil body to protrude the lead from the end thereof, or writing cannot be smoothly performed because its end pipe is kept pushed against the writing sheet.

In view of the foregoing difficulties, the present applicants have proposed a variety of pinch type mechanical pencils disclosed in, for example, U.S. Pat. Nos. 4,270,870 and 4,358,210. In each of the pinch type mechanical pencils thus proposed, substantially as in the case of an automatic lead extending type mechanical pencil, the lead can be extended merely by controlling (or increasing or decreasing) the pinching force applied to the pinching part of the mechanical pencil. However, they are still disadvantageous in that, since the pinching part does not cover all the circumference of the cylindrical mechanical pencil body, an operation of moving the fingers circumferentially of the mechanical pencil body while holding the latter to write cannot be carried out; that is, a so-called "turning and writing operation" cannot be performed, and also they are not so good in external appearance and design.

In order to overcome the above-described difficulties, a pinch type mechanical pencil has been developed in which a pinching part covers all the circumference of the cylindrical mechanical pencil body, and the external appearance is excellent. However, it is still disadvantageous in that, in order to depress the pinching part, it is necessary to apply a relatively great pinching force to the pinching part because of the resistance of the latter, and it is rather difficult to completely or positively restore the pinching part depressed to its original condition. A mechanical pencil of the type disclosed in U.S. Pat. No. 4,358,210 by the present applicants, suffers from the same disadvantages. Further, in such a mechanical pencil, the pinching operation cannot protrude the lead from the tip end pipe. Furthermore, that type of the mechanical pencil requires an intricate slider member.

In view of the foregoing, the present applicants have developed a pinch type mechanical pencil having a fluid pressure mechanism disclosed in U.S. patent application Ser. No. 008,243 filed on Jan. 29, 1987. It is excellent both in function and in design; however, it requires special techniques in manufacture due to a leakage of the fluid.

SUMMARY OF THE INVENTION

Accordingly, an object of the present invention is to eliminate the above-described problems and difficulties accompanying conventional and developed mechanical pencils. More specifically, an object of the invention is to provide a mechanical pencil having an automatic lead extending mechanism which is capable of performing a so-called "turning and writing operation".

It is another object of the invention to provide a mechanical pencil which can protrude a lead from the tip end of the pencil body during the writing.

It is still another object of the present invention to provide a mechanical pencil being capable of extending a lead with a relatively weak pinching force applied to the pencil body without changing the position of fingers.

It is still another object of the invention to provide a mechanical pencil which can be assembled with small the number of components and requires no special techniques in manufacture.

It is still another object of the invention to provide a mechanical pencil which is good in design.

The foregoing and other objects have been achieved by the provision of a mechanical pencil having an automatic lead extending mechanism which, according to the present invention, has a hollow body, a radially displaceable member disposed on an entire circumference of the pencil body, and an inner mechanism including a chuck for clamping a lead, a tightening member which tightens the chuck, a lead holding member holding the lead with a predetermined, relatively weak holding force and a spring, in which the inner mechanism clamps, extends and releases the lead in accordance with a radial movement of the radially displaceable member. The radially displaceable member is formed of a material having following characteristics: durable or readily radially displaceable; strong under varying atmospheric conditions such as temperature and humidity, and durable with respect to the pinching force; restored to its original condition positively, rapidly, and substantially completely; and when a part of the member is radially displaced the remaining parts would not obstruct the radially displacement of the part. The radially displaceable member is substantially round shaped in cross section.

DESCRIPTION OF THE PREFERRED EMBODIMENTS

Preferred embodiments of the present invention will now be described in detail with reference to accompanying drawings.

Figure 1:
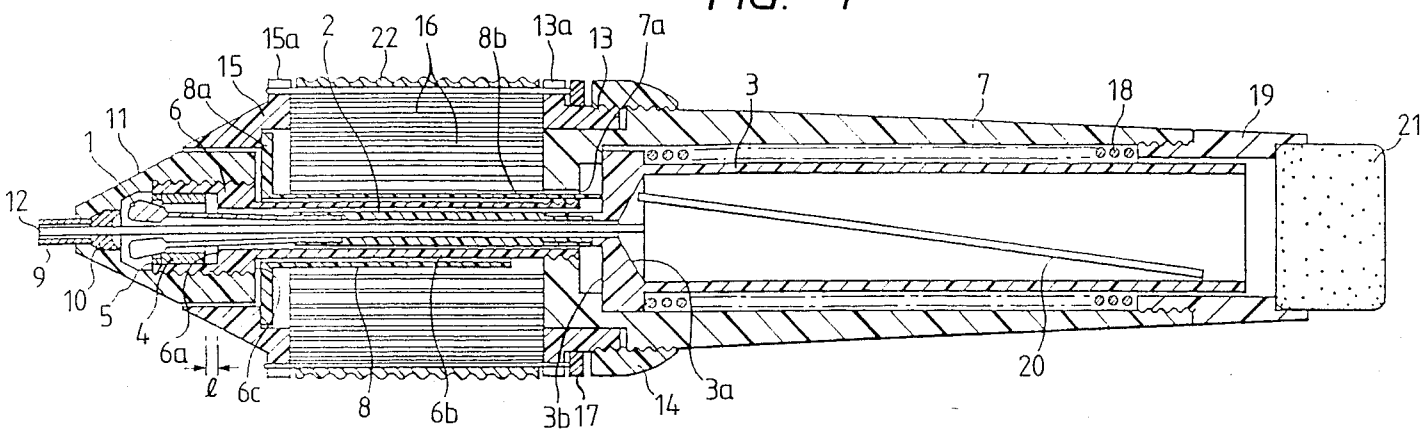
FIG. 1 is a longitudinal sectional view showing a pinch type mechanical pencil which is a first embodiment of the invention.

FIGS. 1 to 5 are longitudinal sectional views showing a mechanical pencil which is a first embodiment of the invention. More specifically, FIG. 1 shows the mechanical pencil to the pinching part of which no pinching force is applied yet; that is, the mechanical pencil is not in use. The mechanical pencil shown in FIG. 1 is of the type that the pinching part is held when it is used to write. The lead is clamped when the fingers holding the pinching part apply a pinching force to the latter, and it is extended (fed) as the pinching force is decreased. In this operation, the length of the mechanical pencil body is maintained unchanged.

The mechanical pencil has a chuck 1 having the front end portion (or the left end portion in FIG. 1) which is longitudinally divided into two or three parts (it being divided into three parts in the case of FIG. 1). Hereinafter, the terms "front" and "rear" as used herein are intended to mean "left" and "right" in each drawing, respectively, when applicable. The head portion of the chuck 1 has a self-expanding force to open itself. A rear end of the chuck 1 is connected to one end of a connecting pipe 2, the other end of which is connected to a front end of a lead case 3. A conical lead guide **3*a* is formed at a front end of the inner cylindrical surface of the lead case 3. A tightening member 4 is disposed on an outer periphery of the chuck 1**.

The tightening member 4 is inserted into a hole formed in a tightening member receiver 6, onto which a mouth ring 11 is screwed. A sliding member 15 having a conical front end portion and a central hole is loosely fitted on the mouth ring 11. Protrusions and grooves **15*a* are formed on the outer cylindrical surface of the sliding member 15. A tightening-member removing ring 5 is press-fitted in the front end portion of the inner hole of the tightening-member receiver 6. In the case of FIG. 1, the tightening member removing ring 5 is provided separately; however, it may be formed by bending the front end portion of the tightening member receiver 6, or the step of the mouth ring 11 may be utilized to stop the forward movement of the tightening member 4. In the latter case, the tightening member removing ring 5** can be eliminated.

The tightening member 4 is slightly movable back and forth between the tightening-member removing ring 5 and the step **6*a* of the inner hole of the tightening member receiver 6. The tightening member receiver 6 has a thin cylindrical rear end portion 6*b*, the rear end part of which is male-threaded. The male-threaded part is engaged with the female-thread central part of the front end portion of a rear holder 7 so that the tightening member receiver 6 and the rear holder 7 form one unit. The rear holder 7 is a cylindrical member for accommodating the lead case 3 (described later). The cylindrical rear end portion 6*b* of the tightening member receiver 6 is slidably inserted into a flanged cylinder 8 which has a flange 8*a*** at its front end thereof.

The flanged cylinder 8 has one to three legs **8*b* (three legs in FIG. 1) extended from its rear side. An annular flanged ring 13 is fitted on the front end portion of the rear holder 7. Protrusions or grooves 13*a* are formed at equal intervals in the outer cylindrical surface of the flanged ring 13. The length between the front end of the flange 8*a* and the rear ends of the legs 8*b* is slightly smaller than the distance between the step 6*c* on the outer surface of the tightening member receiver 6 and the front end face 3*b* of the lead case 3. A spring 18 is interposed between the lead case 3 and the rear holder 7 so that the lead case 3 and the chuck 1 are maintained urged forwardly (to the left in FIG. 1) with respect to the rear holder 7**. Hereinafter, the term "forwardly" as used herein is intended to mean "forwardly" relative to the rear holder which is considered to be "stationary", when applicable).

The above-described mechanical pencil is assembled as follows: First, the legs 8*b* of the flanged cylinder 8 are inserted into the slits 7*a* formed in the central part of the front end portion of the rear holder 7 (the slits 7*a* being equal in number to the legs 8*b*). Then, the rear end portion 6*b* of the tightening member receiver 6 with the tightening member 4 and the tightening member removing ring 5 is screwed into the front end portion of the rear holder 7. Under this condition, the lead case 3 is inserted into the rear holder 7, and the chuck 1 inserted into the tightening member receiver 6 from a front thereof is coupled through the connecting pipe 2 to the lead case 3 by press-fitting, bonding or screwing.

The mouth ring 11 with an end pipe 9 and a lead holder 10 is screwed onto the tightening member receiver 6. The lead holder 10 is made of an elastic material such as rubber so as to always hold the lead 12 with a predetermined holding force. The mouth ring 11 is threadably engaged with the tightening member receiver 6, so that they may be disengaged from each other when necessary. The flanged ring 13 is put on the front end portion of the rear holder 7 from fore side, and a connecting ring 14 is put on the flanged ring 13 and the rear holder 7 from behind so that the flanged ring 13 and the rear holder 7 are threadably engaged through the connecting ring 14.

Under this connection, the sliding member 15 is mounted. As was described above, the protrusions-and-grooves 15*a* are formed in the outer wall of the rear end portion of the sliding member 15. Under the condition that the step 6*c* of the tightening member receiver 6 is in contact with the front end face of the flange 8*a* of the flanged cylinder 8, and the ends of the legs 8*b* of the flanged cylinder 8 are in contact with the front end face 3*b* of the lead case 3, the flanged ring 13 is coupled to the sliding member 15 through a radially displaceable member 16 which is connected between the protrusions-and-grooves 15*a* of the sliding member 15 and the protrusions-and-grooves 13*a* of the flanged ring 13 under tension. A retaining ring 17 is press-fitted on the flanged ring 13 so as to prevent the radially displaceable member 16 from detaching.

The spring 18 is of a compression type. The lead case 3 is inserted into the spring 18. With the front end of the spring 18 abutted against the step of the lead case 3, the spring 18 is inserted into the rear holder 7 while being compressed. Under this condition, a rear end part 19 is screwed into the rear holder 7. After spare leads 20 have been inserted into the lead case 3, an eraser 21 is fitted to the rear end part. In the last assembling step, the radially displaceable member 16 is covered with a rubber cylinder 22 (corresponding to the pinching part of the mechanical pencil) so that the mechanical pencil is fine in appearance and can be suitably held with the fingers.

Figure 11:
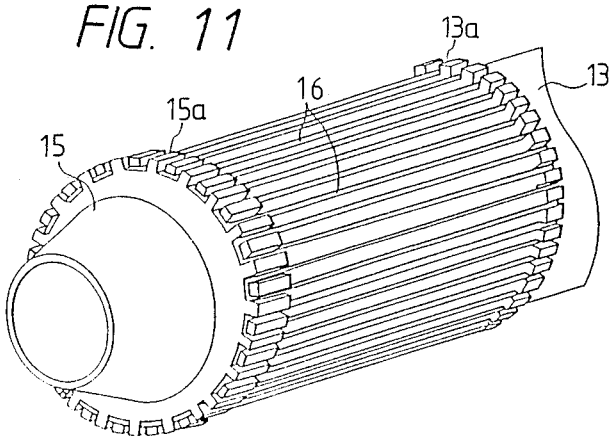
FIG. 11 is a perspective view showing essential components in the mechanical pencil.

The mechanical pencil can be more readily assembled by the following method: With the distance between the flanged ring 13 and the sliding member 15 predetermined, a unit is formed by connecting them with the radially displaceable member 16 (cf. FIG. 11). The unit thus formed is inserted into the mechanical pencil body from fore side, and the flanged ring 13 is coupled through the connecting ring 14 to the rear holder 7.

In the mechanical pencil shown in FIG. 1, the forward movement of the lead case 3 is prevented by abutting against the step in the rear holder 7; however, the mechanical pencil may be so modified that the lead case 3 is allowed to move forwardly until the end of the chuck 1 abuts against the lead holder 10 or the step of the mouth ring 11 thus eliminating the step in the rear holder 7.

Figure 2:
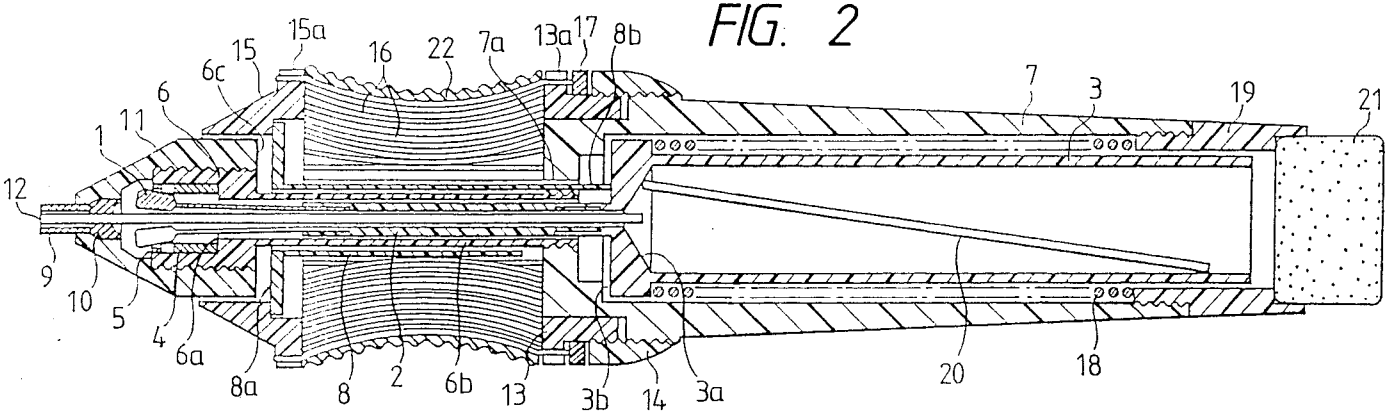
FIGS. 2 through 5 are longitudinal sectional views showing different operating states of the mechanical pencil shown in FIG. 1.

The operation of the mechanical pencil shown in FIG. 1 will be described with reference to FIGS. 2 through 5. FIG. 2 shows the mechanical pencil in the pinching stage; i.e., the rubber cylinder 22 of which a pinching force is applied with the fingers through the thick thereof. That is, as the radially displaceable member 16 is radially inwardly displaced thereby shortening the longitudinal length of the member, the member 16 pulls the sliding member 15, so that the distance between the flanged ring 13 and the sliding member 15 is decreased. In this operation, the sliding member 15 is moved backwardly (or towards the rear holder 7), while the lead case 3 is also moved backwardly because the legs 8*b* of the flanged cylinder 8 push the lead case 3.

Figure 3:
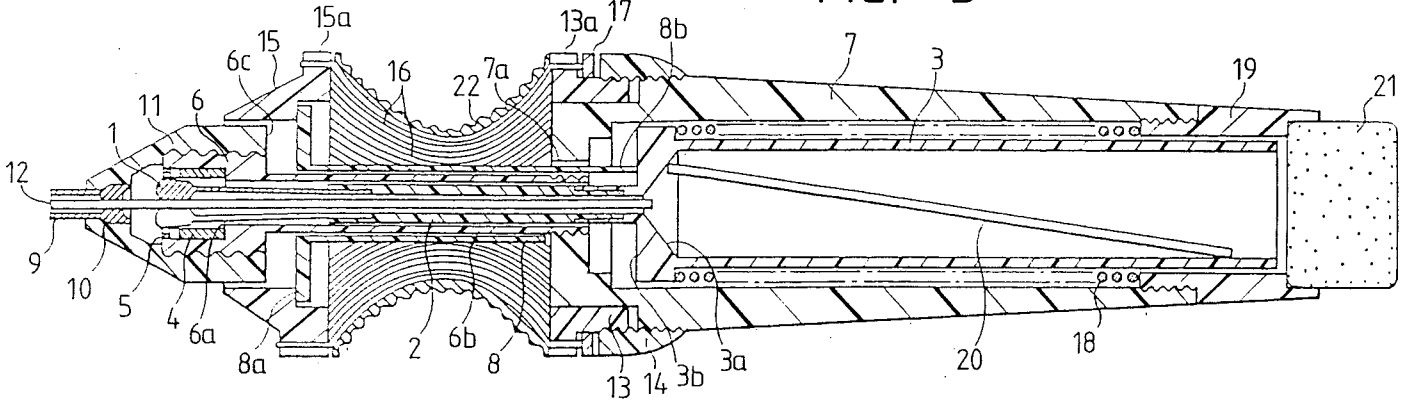
Figure 4:
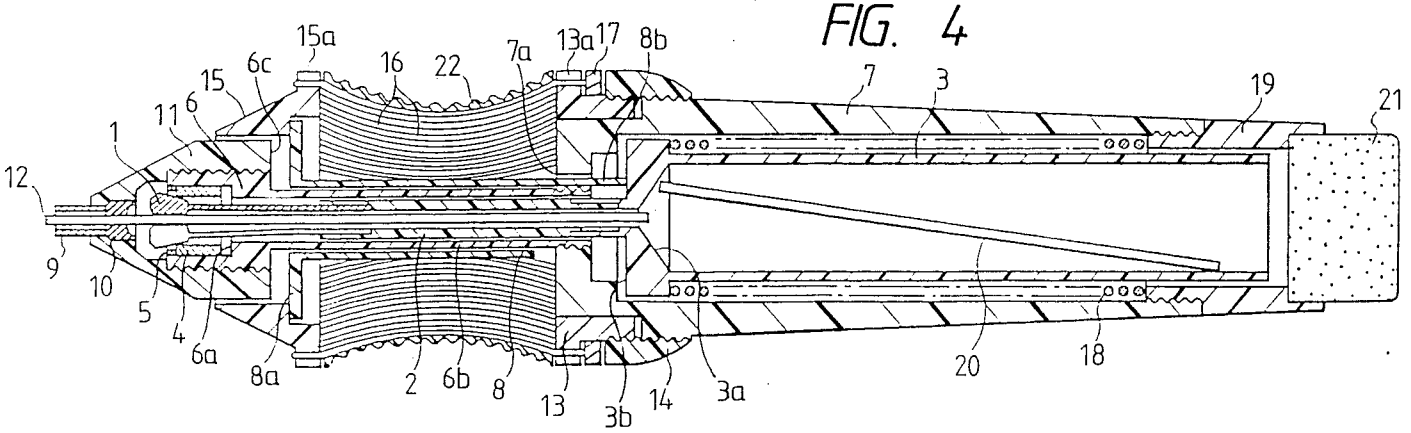

The chuck 1 and the tightening member 4 are moved backwardly as much as the distance l (FIG. 1) for which they can move backwardly with the chuck opened. Since the chuck 1 opens, the lead 12 does not move relative to the mouth ring 11; that is, it does not move backwardly. FIG. 3 shows the mechanical pencil in which the pinching force is further increased. In the state shown in FIG. 3, the radially displaceable member 16 is further radially inwardly displaced, so that the sliding member 15 further moves backwardly. As a result, the chuck 1 engages with the tightening member 4 which has stopped moving backwardly any further, so that the chuck 1 is closed to clamp the lead 12. When the pinching force applied to the mechanical pencil in FIG. 3 is slightly reduced, then the states of the various components thereof are as shown in FIG. 4.

Figure 5:
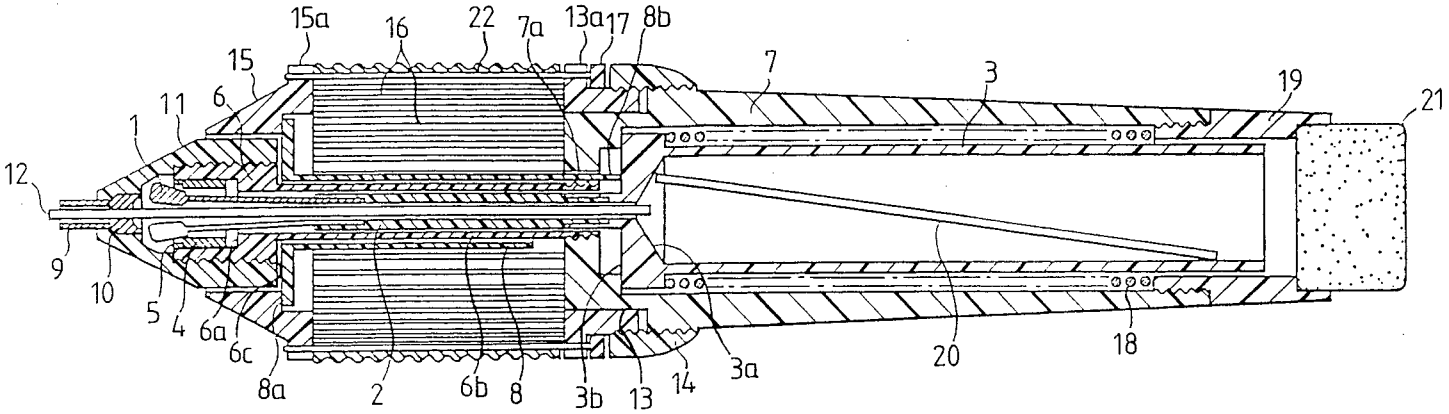

The chuck 1 moves forwardly as much as the distance l while being engaged with the tightening member 4 and clamping the lead 12 accordingly. Therefore, the lead 12 moves forwardly against the predetermined, relatively weak holding force of the lead holder 10, thus protruding from the tip end of the lead pipe 9. As a result, the lead 12 is extended by the distance l. FIG. 5 shows the state of the various components of the mechanical pencil with the pinching force further reduced. In this case, there is no force of moving the sliding member 15 backwardly, and therefore the lead case 3, the connecting pipe 2 and the chuck 1 are moved forwardly by the elastic force of the spring 18, so that the chuck 1 comes out of engagement with the tightening member 4, thus releasing the lead 12.

As is apparent from the above description, the states of the various components shown in FIG. 5 are equal to the states of those in FIG. 1 except that the lead 12 is protruded from the lead pipe 9 as much as the distance l. In FIG. 5, the lead 12 is not fixedly clamped, and therefore, the mechanical pencil cannot be used to write yet. In order to write with the mechanical pencil, a pinching force is applied to the radially displaceable member 16 again, so that the states shown in FIG. 2 and then those shown in FIG. 3 are obtained. When the lead 12 protruded from the end pipe 9 is worn out, then it is extended as much as the distance l by applying the pinching force to the mechanical pencil, and therefore the writing operation can be performed again.

When it is required to initially cause any one of the leads 20 in the lead case 3 to protrude from the end pipe 9, or to replace the lead 12 used with the spare lead 20, the pinching force should be repeatedly applied to the pinching part of the mechanical pencil with the front end thereof kept at the bottom without changing the position of fingers holding the pencil body. With the components held as shown in FIG. 1, the radially displaceable member 16 should be connected under tension. Therefore, the radially displaceable member 16 may preferably be thread-shaped members which are made of materials such as filaments which are small in diameter, high in mechanical strength, low in stretchability (i.e., longitudinally inextensible) and high in flexibility (i.e., radially flexible).

FIGS. 6 through 10 are longitudinal sectional views showing a mechanical pencil which is a second embodiment of the invention.

Figure 6:
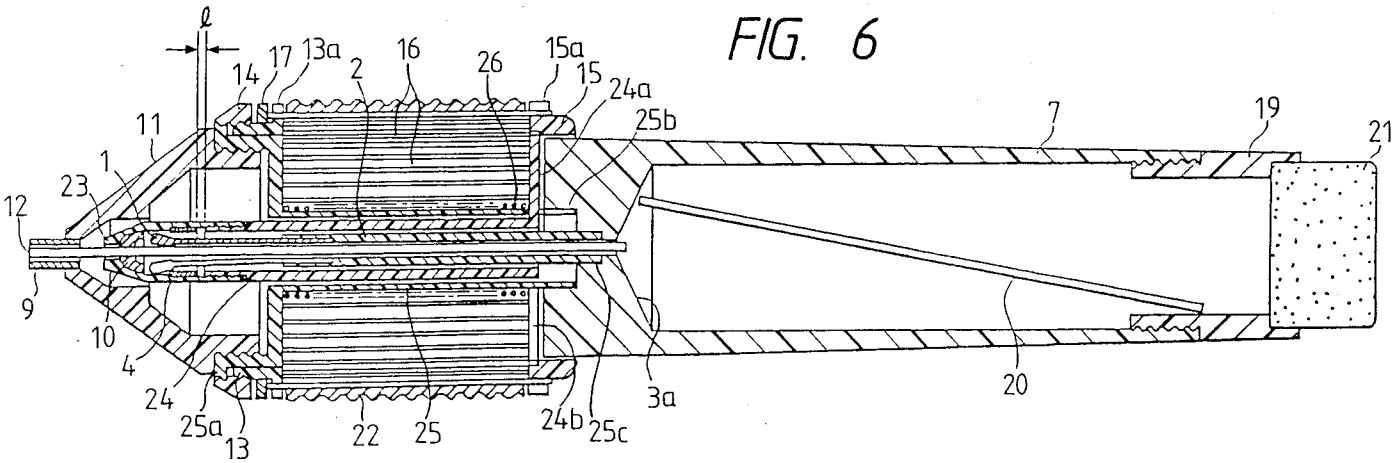
FIG. 6 is a longitudinal sectional view showing a pinch type mechanical pencil which is a second embodiment of the invention.

FIG. 6 shows the mechanical pencil to the pinching part of which no pinching force is applied; that is, which is not in use. The second embodiment is similar to the first embodiment in that the pinching part, namely, the rubber cylinder 22 is pinched with the fingers to use the mechanical pencil. In operation, the mechanical pencil is maintained unchanged in length. In the following embodiments, components corresponding functionally to those in the first embodiment are therefore designated by the same reference numerals or characters. In FIG. 6, a chuck 1 is equal to that in the first embodiment.

A rear end of the chuck 1 is coupled to a front end of a connecting pipe 2, a rear end of which is connected to a front end portion of a rear holder 7. A rear holder 7 serves also as the lead case 3 of the first embodiment. A conical lead guide 3*a* is formed at the front end of the inside of the rear holder 7. The chuck 1 is inserted into the hole of an inner mouth ring 23. A lead holder 10 is fitted in the front end portion of the hole of the mouth ring 23. The rear end portion of the inner mouth ring 23 is threadably engaged with the front end portion of a cornered cylinder 24.

The cornered cylinder 24 is inserted into a coupling 25. The rear end portion of the coupling 25 has one through three slits (three slits in FIG. 6) 25*b*. The corners 24*a* formed at the rear end of the cylinder 24 are engaged with the slits 24*b* thus formed. A tightening member 4 is longitudinally slidably inserted into the hole of the inner mouth ring 23. In such a manner that it is movable back and forth the very short distance l between the front step formed on the inner wall of the inner mouth ring 23 and the front end of the cylinder 24.

The front end portion of the coupling 25 is formed into a large diameter part. The inner cylindrical wall of the large diameter part is female-threaded. An annular flange 25*a* is extended from the front end of the large diameter part. The outer cylindrical wall of the flange, namely, a front end flange 25*a* is male-threaded. The one through three slits 25*b* are formed in the rear end portion of the coupling 25, and are engaged with the corners 24*a* of the cylinder 24.

The rear end portion of the coupling 25 is fixedly press-fitted in the front end portion of the rear holder 7. A mouth ring 11 with an end pipe 9 is threadably engaged with the front end portion of the coupling 25, so that it may be disengaged from the coupling 25 when necessary. A spring 26 is interposed between the front step of the coupling 25 and the corners 24*a* of the cylinder 24 so that the corners 24*a* are urged backwardly (to the right in FIG. 6) at all times. More specifically, the spring 26 is wound around the small diameter part of the coupling 25.

A male-threaded flanged ring 13 is mounted on the front end portion of the coupling 25, and secured to the front end flange 25*a* with a retaining ring 14. Grooves 13*a* are formed in the outer wall of the flange of the flanged ring 13 at equal intervals. Grooves 15*a* are cut in the outer wall of the front end portion of a sliding member 15 at the same intervals as the above-described grooves 13*a*; that is, the number of grooves 15*a* is equal to that of grooves 13*a*. As shown in FIG. 6, the flanged ring 13 and the sliding member 15 are connected with a radially displaceable member 16 under tension.

The radially displaceable member 16 is depressed with a rubber cylinder 22 so that the mechanical pencil can be suitably held with the fingers. A rear end part 19 is threadably engaged with the rear end of the rear holder 7. A spare lead 20 is put into the rear holder 7, and a rubber eraser 21 is fitted to the rear end part 19 to close the lead case. A thread retaining ring 17 is mounted on the front end portion of the flanged ring 13 to prevent the radially displaceable member 16 from detaching. In the case of the second embodiment also, it is preferable to form a sub-assembly comprising the flanged ring 13, the sliding member 15 and the radially displaceable member 16 laid therebetween, because the mechanical pencil can be readily assembled by moving the sub-assembly over the rear holder 7 from behind.

Figure 7:
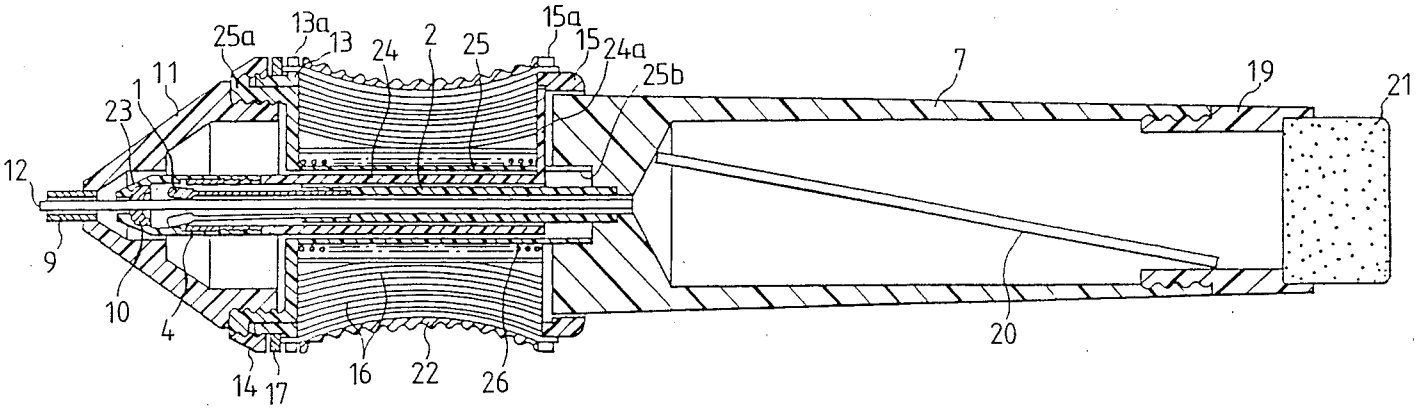
FIGS. 7 through 10 are longitudinal sectional views showing different operating states of the mechanical pencil shown in FIG. 6.

The operation of the mechanical pencil thus constructed will be described with reference to FIGS. 6 through 10. First, the mechanical pencil is held as shown in FIG. 6. When, under this condition, a pinching force is applied to the pinching part thereof, the radially displaceable member 16 is displaced inwardly while the sliding member 15 is moved by a distance l as shown in FIG. 7. Accordingly, the cylinder 24 and the inner mouth ring 23 also move forwardly, as a result of which the lead 12 is held by the lead holder 10 with a predetermined holding force, and pulled through the chuck 1 opened. When, under this condition as shown in FIG. 7, the pinching force is further applied to the pinching part of the mechanical pencil body, the latter will be as shown in FIG. 8; that is, the lead 12 is clamped by the chuck 1.

Figure 8:
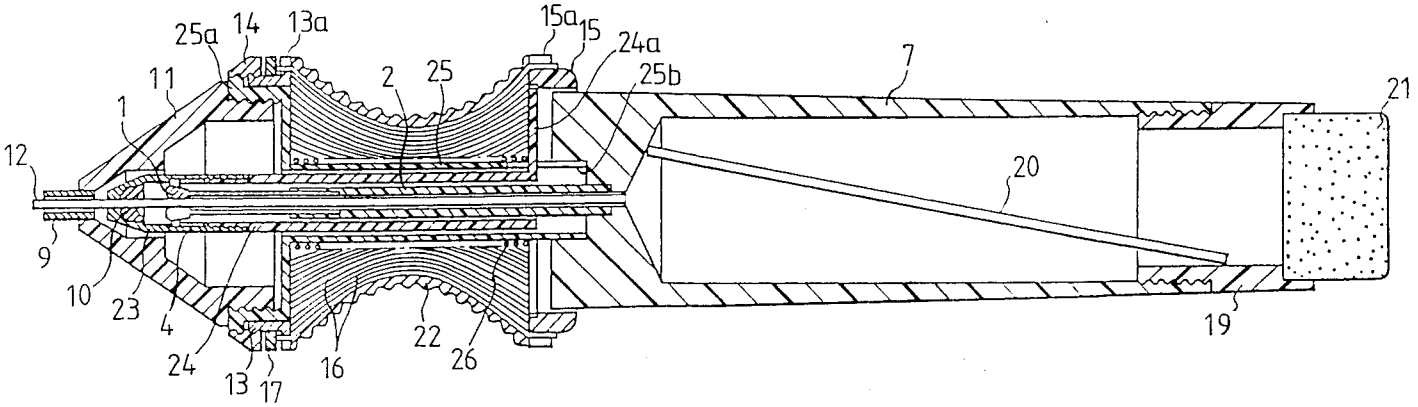
Figure 9:
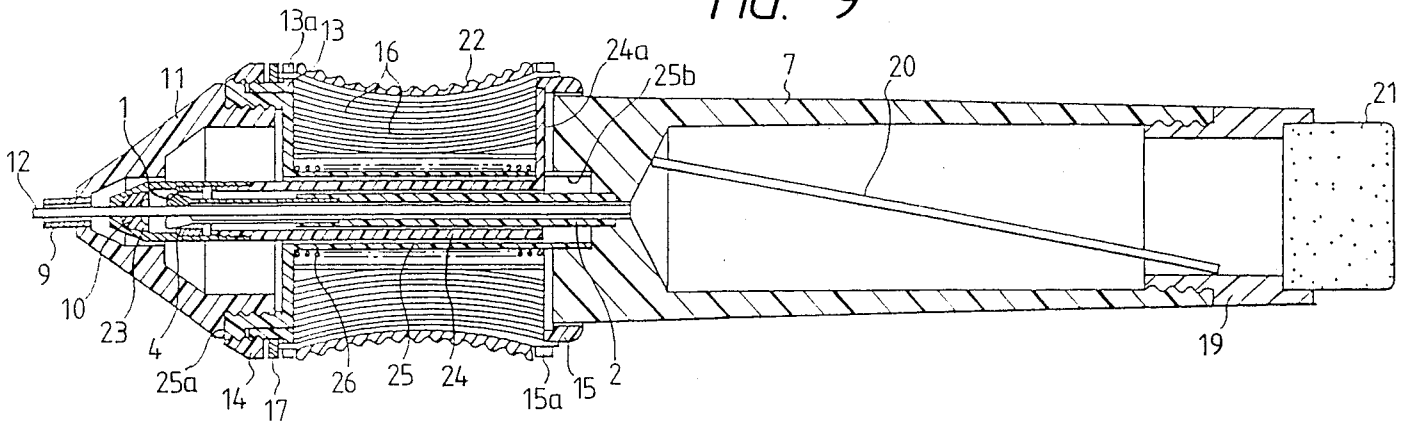

In the state shown in FIG. 7, the end portion of the lead 12 has been protruded from a tip end of the lead pipe 9, and therefore, in the state shown in FIG. 8, the pencil can be used to write. When, under this condition, the pinching force is slightly decreased, then the mechanical pencil will be as shown in FIG. 9. While the cylinder 24 and the inner mouth ring 23, and the lead holder 10 move backwardly by the elastic force of the spring 26, the chuck 1 and the tightening member are maintained engaged with each other and the lead 12 is maintained clamped by the chuck 1, and therefore the the lead holder 10 is slid back along the lead 12; that is, the lead 12 is extended relative to the inner mouth ring 23 and the lead holder 10.

Figure 10:
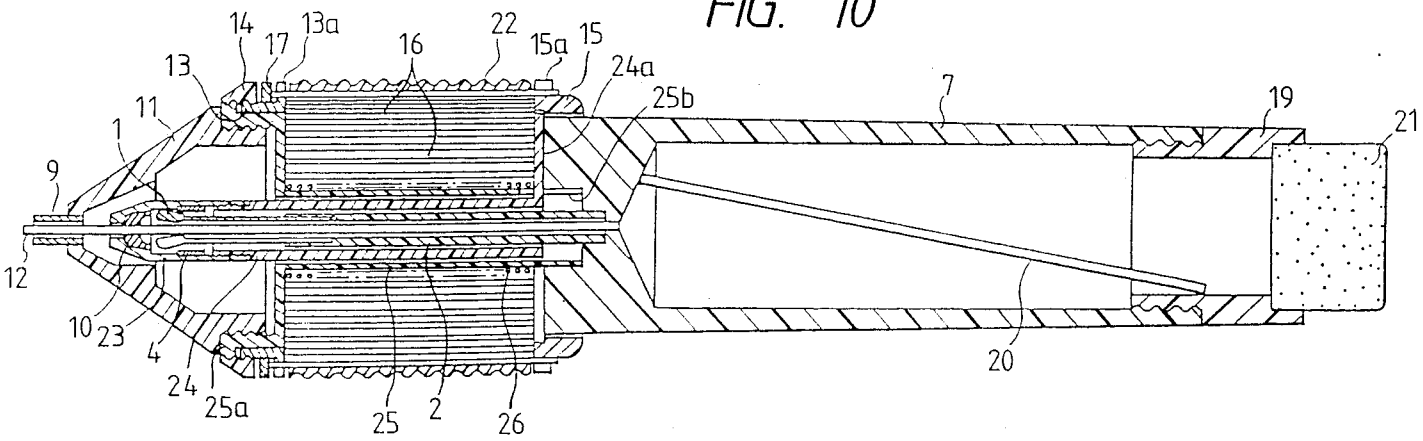

When, under this condition, the pinching force applied to the pinching part of the mechanical pencil is further decreased, the mechanical pencil will be as shown in FIG. 10. The cylinder 24 and the inner mouth ring 23 move backwardly by the elastic force of the spring 26, and therefore the tightening member 4 moves backwardly by the inner step of the inner mouth ring 23, thus being disengaged from the chuck 1. As a result, the lead 12 is released from the chuck 1. If, under this condition, a pinching force is applied to the pinching part of the mechanical pencil again, the lead 12 is further protruded, and is then held.

Figure 12:
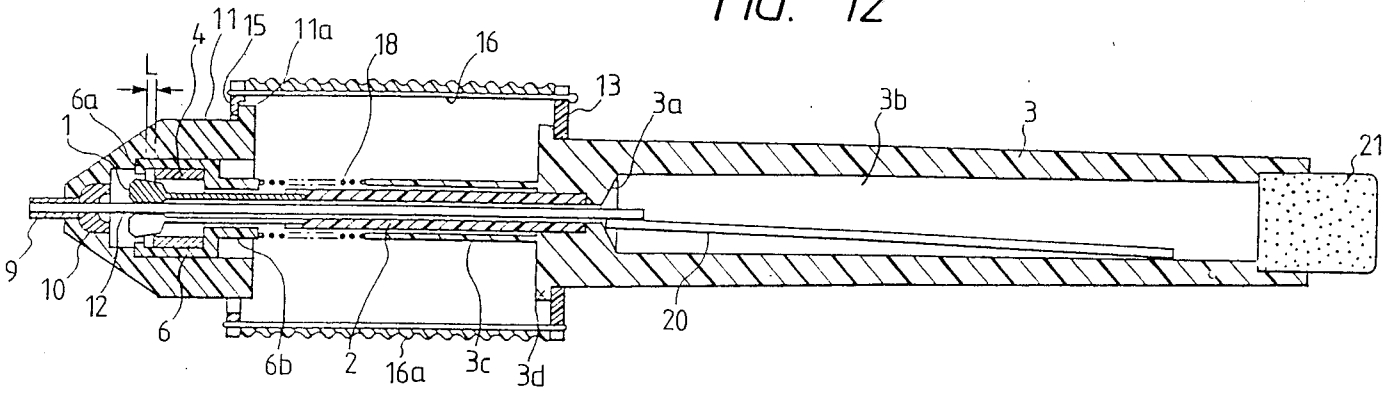
FIG. 12 is a longitudinal sectional view showing a pinch type mechanical pencil which is a third embodiment of the invention.

In the above-described first and second embodiments of the invention, the pinching force applied to the radially displaceable member 16; that is, the pinching part of the mechanical pencil when used is utilized to hold the lead. In a third embodiment of the invention, a chuck spring is utilized to clamp the lead. With the pinching force applied to normally hold the mechanical pencil, the chuck is not operated; that is, it firmly holds the lead to extend it (cf. FIG. 13). In this operation, the total length of the mechanical pencil is decreased. FIG. 12 is a longitudinal sectional view of the third embodiment of the invention. In FIG. 12, the ordinary pinching force is applied to the pinching part of the mechanical pencil.

In the third embodiment, a mouth ring 11 forms the front end portion of the mechanical pencil. A lead pipe 9 is press-fitted in the front end portion of the mouth ring 11. The lead pipe 9 is formed by cutting a metal pipe. A lead holder 10 made of an elastic material such as rubber or synthetic resin is press-fitted into the front end portion of the hole of the mouth ring 11. The lead holder 10, being made of the elastic material as is described above, elastically holds the lead at all times with a predetermined, relatively weak force. A tightening member receiver 6 is provided in the mouth ring 11 in such a manner that it is located behind the lead holder 10 (or to the right of the lead holder 10 in FIG. 12. The tightening member receiver 6 has a flange 6*a* extending inwardly from its front end.

Figure 17:
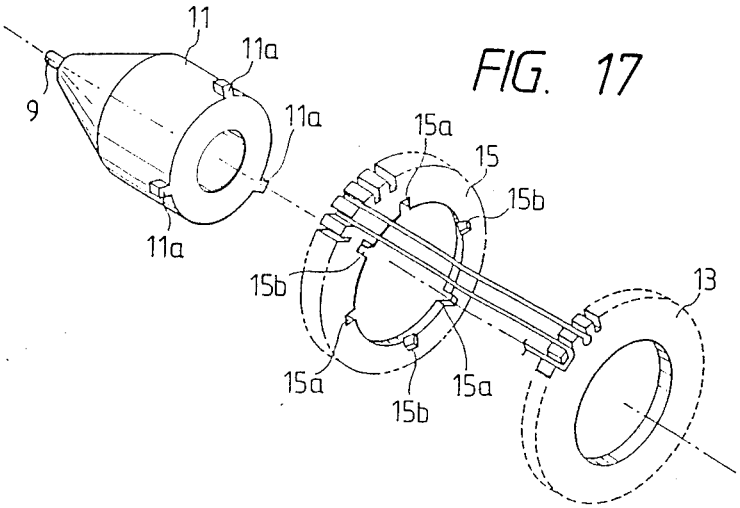
FIG. 17 is an exploded perspective view showing essential components in the mechanical pencil.

The flange 6*a* serves as a stopper which will permit the passage of the chuck 1 but the front end portion of the tightening member 4. It is not always necessary to provide the flange 6*a;* that is, where the flange 6*a* is eliminated, the step provided inside the mouth ring 11 can be utilized to limit the forward movement of the tightening member 4. The backward movement of the tightening member 4 is prevented by the step formed at the rear end of the hole of the tightening member receiver 6. The tightening member receiver 6 has a cylindrical rear end portion 6*b* into which the cylindrical rear end portion of the chuck 1. The mouth ring 11, as shown in FIG. 17, has three protrusions arranged at the rear end at angular intervals of 120 degrees.

The rear end of the chuck 1 is connected to a coupling pipe 2, the rear end portion of which is fixedly press-fitted in the front end portion of a lead case 3. In the third example, the lead case 3 serves as the rear holder of the mechanical pencil. That is, the lead case 3 forms the rear end portion of the mechanical pencil, and has a flange 3*d* at the front end. The lead case 3 has a spare lead chamber 3*b*, in which a spare lead 20 is inserted. The front end wall of the spare lead chamber 3*b* is formed into a conical lead guide 3*a*.

A cylinder 3*c* small in wall thickness extends forwardly from the front end face of the lead case 3. A spring 18 (which is greater in elastic force than that of the ordinary knock type mechanical pencil) is interposed between the cylinder 3*c* and the rear end portion 6*b* of the tightening member receiver 6 so that the lead case 3 and the tightening member receiver 6 are urged to move away from each other at all times. That is, the lead case 3 is pushed backwardly with respect to the tightening member receiver 6 by the elastic force of the spring 18, so that the chuck 1, being urged through the coupling pipe 2, also moves backwardly in the tightening member receiver 6. As a result, the chuck 1 is engaged with the tightening member 4, thus, clamping the lead 12.

A front ring 15 and a rear ring 13 positioned as required are connected with a radially displaceable member 16 under tension. The radially displaceable member 16 may preferably be thread-shaped members such as thin metal wires; however, it must be such that it can easily be displaced inwardly when the pinching force is increased, and it is restored when the pinching force is brought back to the former condition. That is, the member may be made of strong and rigid materials, such as chemical synthetic fibers, natural fibers, metal wires or synthetic resin filaments.

Grooves are cut in the outer cylindrical wall of the front ring 15, and similarly grooves are formed in the outer cylindrical wall of the rear ring 13. A radially displaceable member 16 is fitted in the grooves of the front ring 15 and the grooves of the rear ring 13 alternately, and both ends of the radially displaceable member are fastened to the rings 13 and 15. The center hole of the front ring 15 is larger in diameter than the flange 3*d* of the lead case 3 so that the flange 3*d* can pass through the front ring 15. As shown in FIG. 17, three cuts 15*a* are formed in the inner cylindrical wall of the front ring 15 at angular intervals of 120°, and three recesses 15*b* are also formed in the inner end face of the front ring 15 at angular intervals of 120° in such a manner that they 15*b* are located at middle of the aforementioned cuts 15*a*, respectively.

First, the front ring 15, the rear ring 13 and the thread-shaped member 16 are assembled to form a sub-assembly. The lead case 3 is inserted into the sub-assembly from front side thereof until the front end flange 3*d* thereof abuts against the rear ring 13 (the flange 3*d* being freely passed through the front ring 15). With the cuts 15*a* of the front ring 15 in alignment with the protrusions 11*a* of the mouth ring 11, the spring 18 is compressed to move the mouth ring 11 and the lead case 3 towards each other. After the protrusions 11*a* have been passed through the cuts 15*a*, the front ring 15 is turned through 60° either clockwise or counterclockwise. When the recesses 15*b* of the front ring 15 confront the protrusions 11*a* of the mouth ring 11, the chuck spring 18 is released, so that the front ring 15 is engaged with the mouth ring 11 with the protrusions 11*a* inserted in the recesses 15*b*. In this operation, the radially displaceable member 16 is stretched under tension, thus eliminating the twist, and the chuck 1 is engaged with the tightening member 4 by the elastic force of the spring 18, thus clamping the lead 12.

As shown in FIG. 12, the radially displaceable member 16 is covered with a rubber cylinder 22 so that the mechanical pencil feels soft when held with the fingers. A rubber eraser 21 is fitted in the rear end portion of the lead case 3.

Figure 13:
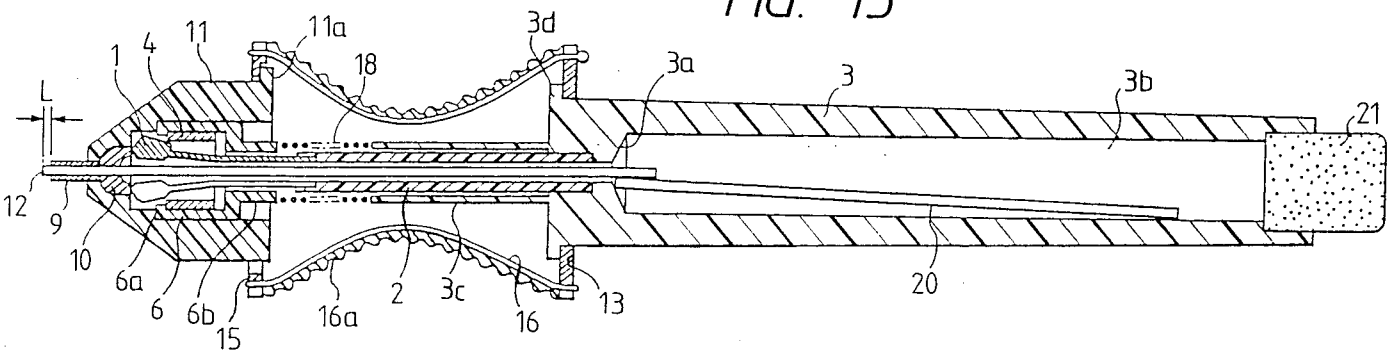
FIGS. 13 and 14 are longitudinal sectional views showing different operating states of the mechanical pencil shown in FIG. 12.

When, with the mechanical pencil as shown in FIG. 12, the ordinary pinching force applied to the pinching part during writing is increased, then the lead 12 is extended as shown in FIG. 13. That is, in this operation, the radially displaceable member 16 is displaced radially inwardly, so that the spring 18 is compressed to move the mouth ring 11 and the lead case 3 towards each other; that is, the total length of the mechanical pencil is decreased. The chuck 1 is engaged with the tightening member 4, and, while clamping the lead 12, moved a distance L for which the tightening member 4 is movable in the forward direction as shown in FIG. 12, as a result of which the lead 12 is protruded as much as the distance L from a tip end of the end of the lead pipe 9 against the predetermined, relatively weak holding force of the lead holder 10.

Figure 14:
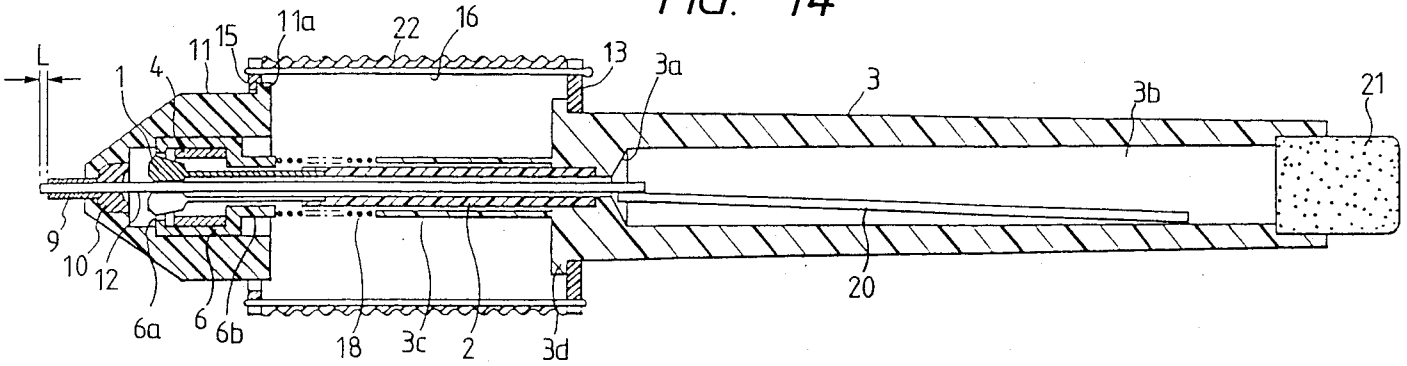

The chuck 1 further moves forwardly; however, since the tightening member 4 is prevented from moving by the flange 6*a*, the chuck 1 is disengaged from the tightening member 4, thus releasing the lead 12. In this operation, tightening member 4 is thrown by the self expanding force of the chuck 1 against the rear step of the tightening member receiver 6; however, immediately it is returned by its own weight as shown in FIG. 13. FIG. 14 shows a state of the mechanical pencil provided when the pinching force used to operate the mechanical pencil as shown in FIG. 13 is restored.

The lead 12 is protruded by the length L from the lead pipe 9, and the chuck 1 and the tightening member 4 are fixedly engaged with each other in the tightening member receiver 6 by the elastic force of the spring 18; that is, the lead 12 is positively held by the chuck 1. Thus, the mechanical pencil has become ready for writing. When the ordinary pinching force for writing is applied to the pinching part of the mechanical pencil, a force corresponding thereto is applied to the chuck in the forward direction; however, the spring 18 is greater in elastic force than that of the ordinary knock type mechanical pencil, so that the lead is positively clamped by the chuck.

When the lead 12 at the end of the lead pipe 9 is worn out, then, as is described above, the lead is extended as much as the length L by momentarily increasing the pinching force applied to the pinching part of the mechanical pencil. That is, the operator can protrude the lead 12 from the end of the lead pipe 9 merely by momentarily increasing the pinching force without changing the positions of the fingers pinching the mechanical pencil, to continue the writing operation.

Figure 15:
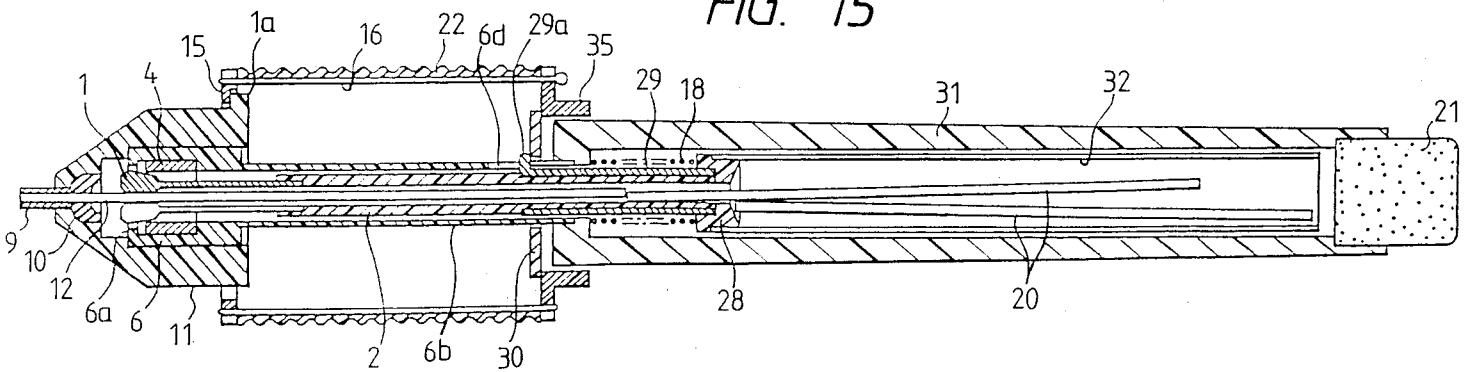
FIG. 15 is a longitudinal sectional view indicating a pinch type mechanical pencil which is a fourth embodiment of the invention.

FIG. 15 is a longitudinal sectional diagram showing a mechanical pencil which is a fourth embodiment of the invention.

More specifically, FIG. 15 shows the mechanical pencil to the pinching part of which no strong pinching force is applied yet. The fourth embodiment is fundamentally equal in construction to the third embodiment; however, the former is different from the latter in that it is maintained unchanged in total length when operated. In the fourth embodiment, its tightening member receiver 6 has a longer leg 6*b* in the rear end portion of which three slits 6*d* and cut at angular intervals of 120° C. A coupling pipe 2 is connected to the rear end of a chuck 1. A cornered cylinder having corners 29*a* formed on its outer cylindrical wall at angular intervals of 120° is fixedly press-fitted in the rear end portion of the coupling pipe 2.

The corners 29*a* are inserted into the slits 6*d*, respectively. The cylinder 29 is inserted into the center hole of a receiving ring 30. The rear end portion of the leg 6*b* of the tightening member receiver 6 is press-fitted into the front end of a rear holder 31. A spring 18 is mounted over the rear end portion of the cylinder 29 extending in the rear holder 31. The rear end of the cylinder 29 together with the rear end portion of the coupling pipe 2 is fixedly press-fitted in a lead guide 28 coupled to a lead case 32. The front end face of the receiving ring 30 abuts against the corners 29*a* of the cylinder 29, and the rear end face thereof is in contact with the front end face of a slide ring 35.

A radially displaceable member 16 is stretched between the slide ring 35 and a front ring 15; that is, the two ring 15 and 16 are coupled to each other through the radially displaceable member 16. In the fourth embodiment, the spring 18 is interposed between the lead guide 28 and the front end of the longitudinal hole of the rear holder 31.

In the third embodiment, the front end part (the mouth ring) is not coupled to the rear end part (the rear holder) through the tightening member receiver 6; that is, they are coupled to each other merely with the radially displaceable member 16. Therefore, when the pinching force applied to the pinching part (the radially displaceable member) is increased, the radially displaceable member 16 is displaced radially inwardly to move the mouth ring 11 and the rear holder towards each other. That is; the length of the mechanical pencil is decreased.

On the other hand, in the fourth embodiment, the total length thereof will not be decreased, because the tightening member receiver 6 is used to make the mouth ring 11 and the rear holder 31 integral. That is, in the fourth embodiment, the slide ring 35 moves forwardly to move the receiving ring 30 forwardly, so that the cornered cylinder 29, the lead case 32, the coupling pipe 2, and the chuck 1 move forwardly through the corners 29*a* while the spring 18 being compressed. The operation of the fourth embodiment is substantially equal to that of the third embodiment.

Figure 16:
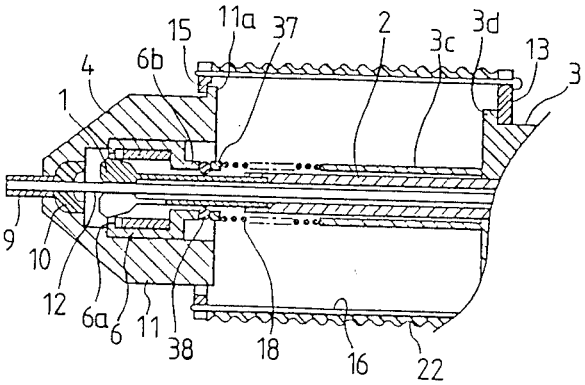
FIG. 16 is a longitudinal sectional view showing essential components of a pinch type mechanical pencil which is a fifth embodiment of the invention.

FIG. 16 is a longitudinal sectional view showing essential components of a fifth embodiment of the invention.

The fifth embodiment is fundamentally equal both in construction and in function to the above-described third embodiment. If the radially displaceable member 16 are so designed as to be readily displaced radially inwardly by a relatively weak pinching force, then the mechanical pencil may suffer from a difficulty that the ordinary pinching force applied during writing may move the chuck 1 forwardly to release the lead 12. This difficulty can be eliminated by the fifth embodiment. In the third embodiment, increasing the elastic force of the chuck spring 18 is limited. Therefore, in the fifth embodiment, as shown in FIG. 16 a washer 37 and a breaker, namely, an O-ring 38 formed of an elastic material such as a rubber or the like are interposed between the rear end of the leg 6*b* of the tightening member receiver 6 and the front end of the spring 18 in the third embodiment. The breaker 38 is elastically strongly abutted against the cylindrical portion of the chuck 1.

The frictional force between the O-ring and the chuck prevents the chuck 1 from being readily moved, thus stably holding the chuck 1. As is described above, the breaker 38 is positioned between the leg 6*b* of the tightening member receiver 6 and the spring 18. However, the invention is not limited thereto or thereby. For instance, in the cases of the third and fourth embodiments, it may be disposed between the chuck 1 and the tightening member receiver 6; and in the case of the fourth embodiment, it may be interposed between the cornered cylinder 29 and the inner surface of the front step of the rear holder 31.

FIGS. 18 through 21 are sectional views showing a sixth embodiment of the invention. The sixth embodiment is fundamentally equal both in construction and in function to the third or fourth embodiment. However, the former is clearly different from the latter in that the pinching part is divided into two parts; a holding part which is held with the fingers for writing, and a lead extending part, that is, a radially displaceable member which is pinched to extend the lead. The lead extending part is located adjacent to the holding part. When the lead is extended, the total length of the mechanical pencil is decreased. In the sixth embodiment, the male-threaded front end portion of a tightening member receiver 6 is threadably engaged with the female-threaded rear end portion of the hole in a mouth ring 11. A tightening member 4 is slidably inserted into the axial hole formed in the tightening member receiver 6. The rear end of a chuck 1 is connected to the front end of a coupling pipe 2, the rear end portion of which is screwed into the front end of a rear holder 7, which acts as a lead case.

The coupling pipe 2 is inserted into a pipe 40, the front end portion of which is fixedly press-fitted in the tightening member receiver 6. The other end portion of the pipe 40 is inserted in a spring hole 44 formed in the front end of the rear holder 7. A chuck spring 18 compressed is arranged in the spring hole 44 in such a manner that it is interposed between the rear holder 7 and the rear end of the pipe 40. That is, the tightening member receiver 6 and the rear holder 7 are urged by the elastic force of the chuck spring 18 to move away from each other.

The tightening member receiver 6 and the rear holder 7 are coupled to each other through a radially displaceable member 41 which is made cylindrical when assembled. The radially displaceable member 41 may preferably be made of a piece of cloth woven with synthetic fibers and/or natural fibers. In order to prevent the radially displaceable member 41 from being made dirty or to prevent the slip of the fingers on the radially displaceable member 4, a conventional surface protecting agent of synthetic resin or the like should be applied to the outer surface of the radially displaceable member 41.

The front end portion of the radially displaceable member 41 is wound on the tightening member receiver 6, and is covered tight with a fixing cylinder 42 which is the holding part held with the fingers for writing, as a result of which the radially displaceable member 41 is fixedly secured to the tightening member receiver 6. The rear end portion of the radially displaceable member 41 is wound on the front end of the rear holder 7, and is covered tight with a fixing cylinder 43 so as to be fixedly secured to the rear holder 7.

Figure 18:
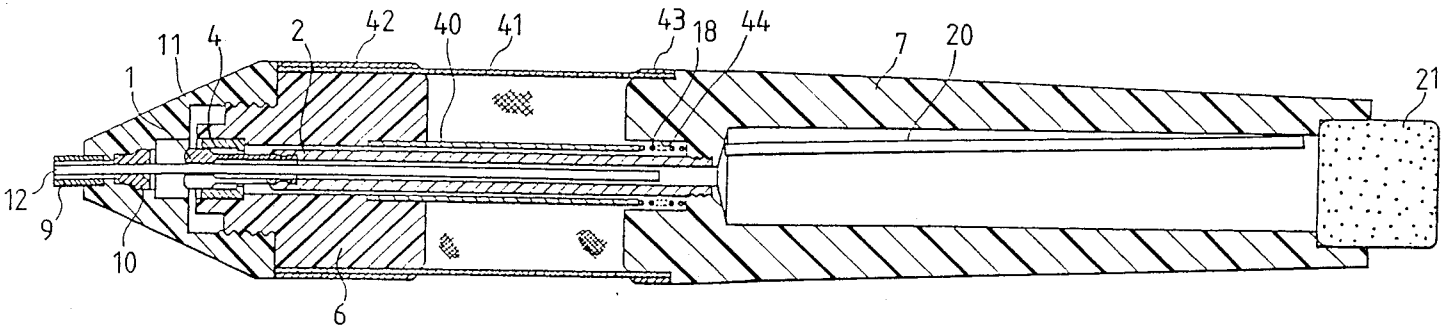
FIG. 18 is a longitudinal sectional view showing a pinch type mechanical pencil which is a sixth embodiment of the invention.
Figure 20:
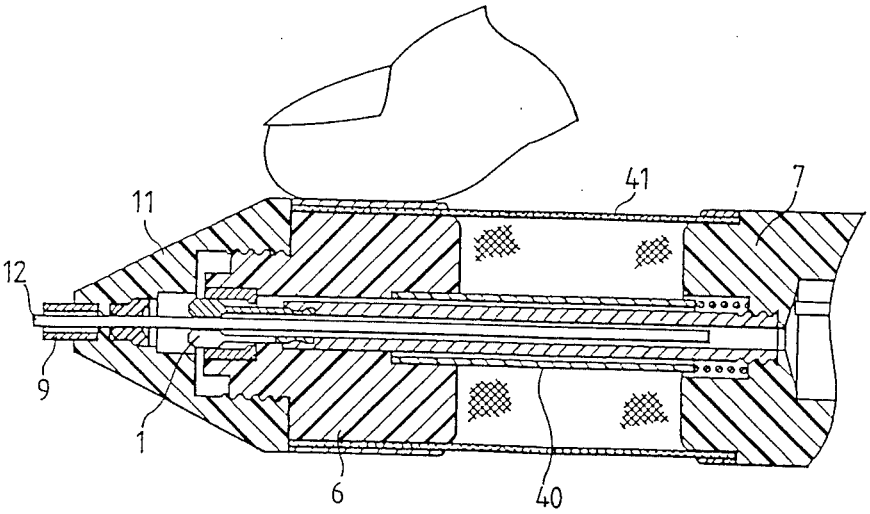
Figure 21:
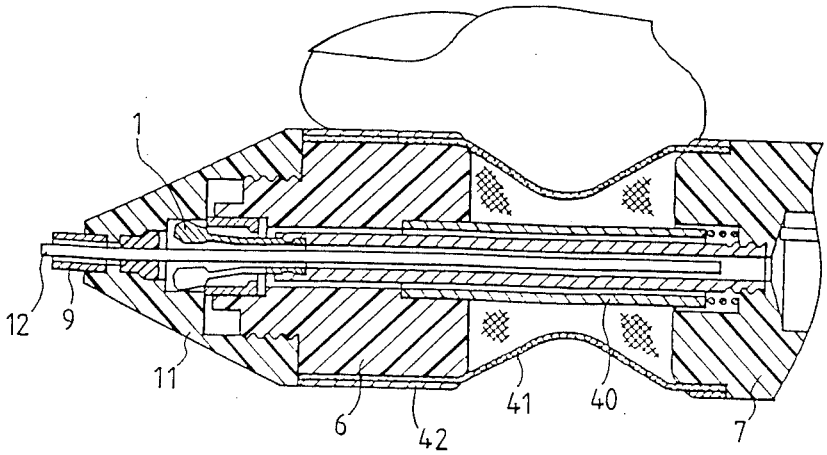

The operation of the sixth embodiment will now be described. Before writing, as shown in FIG. 20 the holding part; i.e., the fixing cylinder 42 is held similarly as in the case of the conventional mechanical pencil. When, during writing, the lead is worn out as shown in FIG. 18, the finger is laid over the radially displaceable member 41 in such a manner as to jerk the mechanical pencil body forwardly, as a result of which, as shown in FIG. 21, the radially displaceable member 41 is depressed by the thick of the finger, thus being displaced inwardly; that is the diameter thereof is decreased, and therefore the tightening member receiver 6 and the rear holder 7 move towards each other. That is, if it is assumed for convenience in description that the tightening member receiver 6 is stationary, then the chuck 1 integral with the rear holder 7 moves forwardly while compressing the chuck spring 18.

Figure 19:
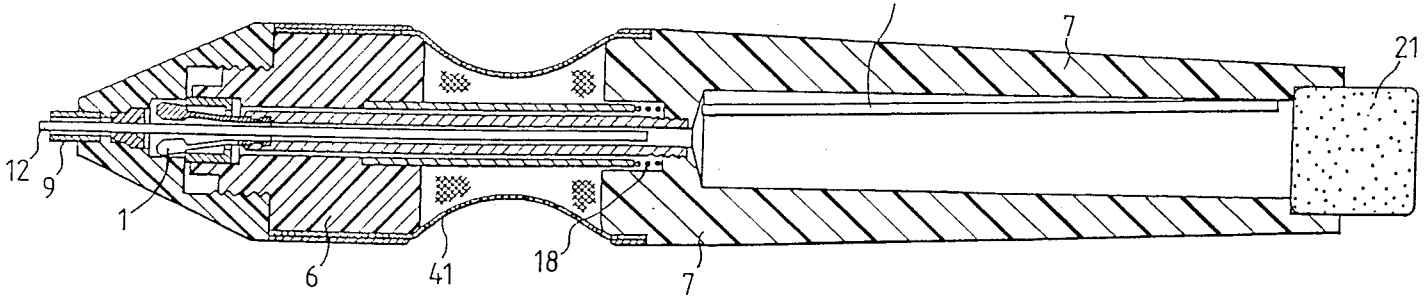
FIGS. 19, 20 and 21 are longitudinal sectional views indicating different operating states of the mechanical pencil shown in FIG. 18.

As a result, completely similarly as in the conventional knock type mechanical pencil, the lead 12 is protruded from the end pipe 9, and the chuck 1 is disengaged from the tightening member 4, thus releasing the lead 12. With the lead 12 protruded from the end pipe 9 as shown in FIG. 19, the finger is raised in such a manner as to jerk the mechanical pencil body backwardly; that is, the pinching force applied to the radially displaceable member 41 is removed. As a result, the rear holder 7 moves backwardly by the elastic force of the chuck spring 18; that is, in the mechanical pencil, as shown in FIG. 20, the chuck 1 is engaged with the tightening member 4, thus clamping the lead 12.

Similarly as in the conventional knock type mechanical pencil, the mechanical pencil of the invention is operated for writing. Of the fingers holding the holding part, only one finger may be used to push the radially displaceable member to extend the lead.

Figure 22:
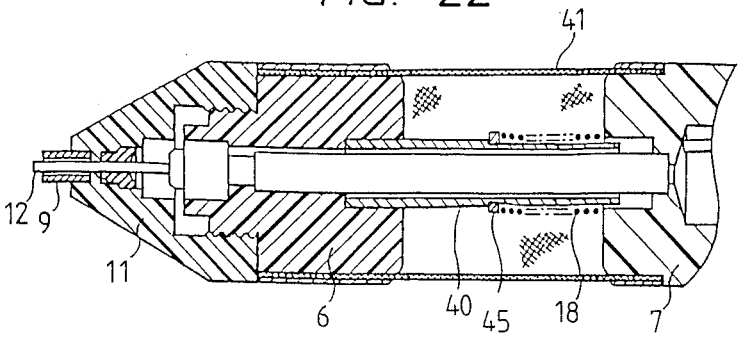
FIG. 22 is a longitudinal sectional view showing essential components of a pinch type mechanical pencil which is a seventh embodiment of the invention.

FIG. 22 shows a seventh embodiment of the invention. The seventh embodiment is fundamentally equal both in construction and in function to the sixth embodiment. However, the former is different from the latter in the mounting position of its chuck spring 18. That is, the chuck spring 18 is interposed between the front end face of the rear holder 7 and a spring retainer 45 which is fixedly mounted on the middle portion of the pipe 40.

Figure 23:
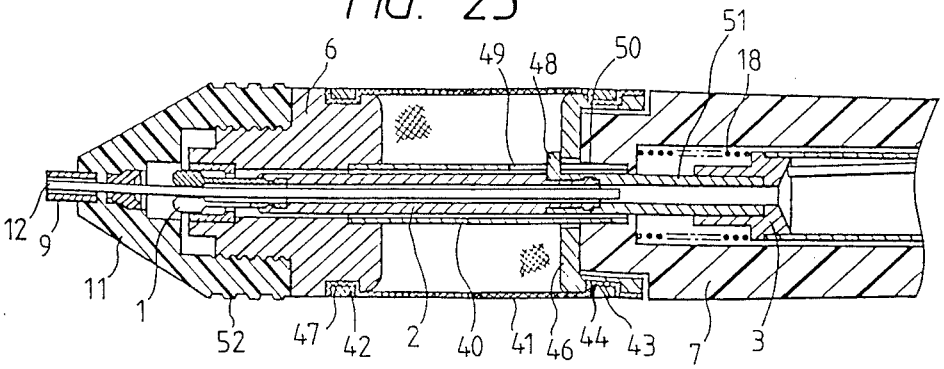
FIG. 23 is a longitudinal sectional view showing essential components of a pinch type mechanical pencil which is an eighth embodiment of the invention.

FIG. 23 shows an eighth embodiment of the invention. The eighth embodiment is fundamentally equal both in construction and in function to the sixth or seventh embodiment. However, while in each of the sixth and seventh embodiments the total length of the mechanical pencil body is decreased in extending the lead 12, in the eighth embodiment the length of the mechanical pencil is maintained unchanged. Similarly as in the above-described sixth or seven embodiment, the mechanical pencil has a holding part and a lead extending part. The front end portion of a radially displaceable member 41 is wound on the rear end portion of a tightening member receiver 6, and a fixing ring 42 is press-fitted through the radially displaceable member 41 into an annular groove 47 formed in the outer cylindrical wall of the rear end portion of the tightening member receiver 6, so that the radially displaceable member 41 is fixedly secured to the latter 6.

The rear end portion of the radially displaceable member 41 is wound on a slide cylinder 46 which is movable back and forth, and a fixing ring 43 is press-fitted through the radially displaceable member 41 into an annular groove 44 formed in the outer wall of the slide cylinder 46, so that the radially displaceable member 41 is fixedly secured to the slide cylinder 46. The slide cylinder 46 has a bottom, or end face, with a center hole 50. The rear end of the chuck 1 is connected to a coupling pipe 2, the rear end of which is coupled to the front end portion of a cornered pipe 51. The rear end of the pipe 51 is fixedly press-fitted in the front end face of a lead case 3.

The pipe 51 has three corners 48 at the front end, which are slidably inserted in slits 49, respectively, which are formed in a pipe 40. A spring 18 is interposed between the lead case 3 and the inner wall of the bottom of a rear holder 7 so that the corners 48 are pushed against the front end face of the bottom of the slide cylinder 46. In the eighth embodiment, the outer cylindrical surface of the holding part comprising the mouth ring 11, the tightening member receiver 6 and the fixing ring 42 is flush with the outer cylindrical surface of the radially displaceable part comprising the radially displaceable member 41. The eighth embodiment may be modified as follows: That is, the outer cylindrical surface of the mouth ring 11 is roughened as indicated at 52 so that the fingers can more positively hold the mechanical pencil; or the rear end portion of the holding part has a smooth but wavy surface; or the holding part is moderately tapered so that it may be readily and comfortably held with the fingers. Furthermore, the embodiment may be modified in various manners so that the pencil holding operation and the lead extending operation may be smoothly switched over to each other.

The eighth embodiment operates as follows: Similarly as in the above-described sixth or seventh embodiments, when the radially displaceable member 41 is pinched with the thick of the finger, the slide cylinder 46 is moved towards the tightening member receiver 6. In this operation, the slide cylinder 46 is engaged with the corners 48, so that the chuck 1, the lead 12, the pipe 51, and the lead case 3 are moved forwardly as one unit while the spring 18 is compressed by the lead case 3. When the radially displaceable member 41 is released, it is restored by the elastic force of the spring 18, and only the lead 12 is extended.

The lead extending and holding operation in the eighth embodiment is different from that in the conventional knock type mechanical pencil only in that the conventional knock type mechanical pencil is operated by knocking it whereas the mechanical pencil of the invention is operated by pushing the radially displaceable member.

The eighth embodiment is advantageous in the bending strength of its body, because it is maintained unchanged in length when operated.

Figure 24:
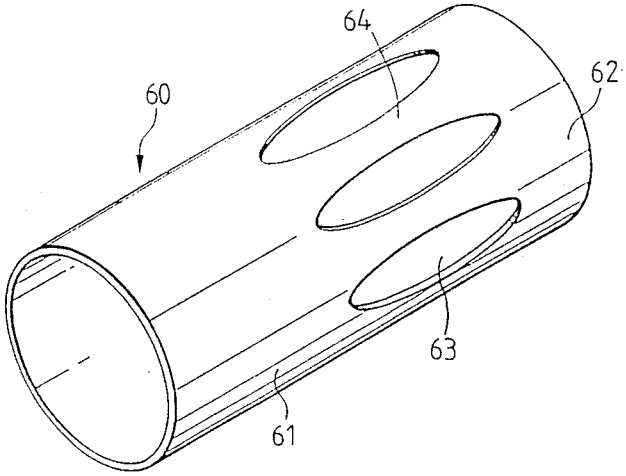
FIG. 24 is a perspective view showing one modification of a radially displaceable member employed in the invention.

FIG. 24 shows one modification of the radially displaceable member 41 of the eighth embodiment. In FIG. 24, a cylinder 60 is made of a thin synthetic resin plate, preferably a material which is flexible, but less elongated in the axial direction when pulled. Both ends 61 and 62 of the cylinder 60 are secured similarly as in the case of the eighth embodiment. The front end portion and rear end portion of the cylinder 60 serve as the pencil holding part and the lead extending part, respectively.

Figure 25:
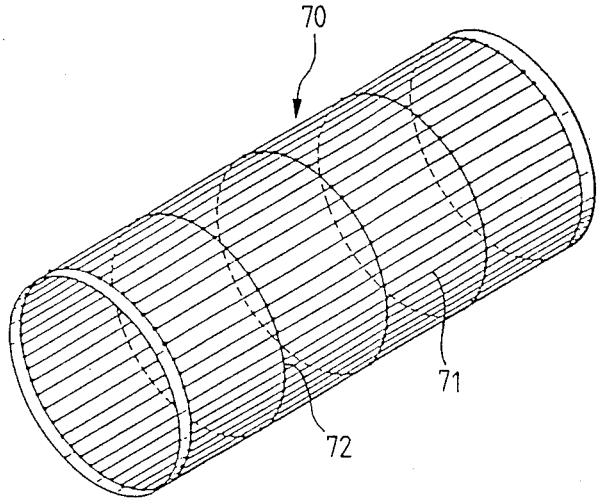
FIG. 25 is a perspective view showing another modification of the radially displaceable member.

Elongated holes 63 are formed in the rear end portion of the cylinder 60 in such a manner that they are extended in the axial direction to form pushing portions 64 therebetween, which can readily be bent with the thick of the finger. FIG. 25 shows a cylinder 70 which is another modification of the radially displaceable member 41. The cylinder 70 comprises a number of thread-shaped members 71 arranged in the axial direction, and annular retaining rings 72 secured to the thread-shaped members 71. Similarly as in the case of the cylinder 60, both ends of the cylinder 70 are secured.

The cylinders shown in FIG. 24 and 25 can readily be formed as components, which facilitate the assembling of the mechanical pencils according to the invention. The same effect may be obtained by using a net-shaped cylinder.

Other than described above, the radially displaceable member may be formed of many materials if it has following characteristics: readily radially displaceable; strong under varying atmospheric conditions such as temperature and humidity, and durable with respect to the pinching force; restored substantially to its original condition positively, rapidly and completely; and when a part of the member is radially displaced, the remaining parts would not obstruct the radially displacement of the part. Further, the radially displaceable member should substantially be round shaped in cross section. The longitudinal length of the radially displaceable member shortens in accordance with the radial displacement thereof.

In view of the above characteristics, the radially displaceable member may be thread-shaped members formed of a fishing line or a metal wire, monofilament, a gauze, a flexible cloth, a net, a bag, a flexible metal thin plate, a rubber, a metal having a plurality of longitudinal slits, a cylinder formed of a synthetic resin, a cellophane tube, a thermosetting film tube or the like.

Figure 26:
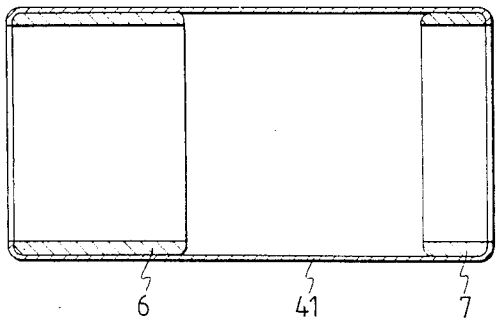
FIG. 26 is a cross sectional view showing an essential part of the mechanical pencil according to the invention, in which a thermosetting film tube is employed a radially displaceable member.

FIG. 26 is a cross sectional view showing an essential part of the mechanical pencil, in which a thermosetting film tube is employed as a radially displaceable member 41 of the sixth embodiment of the mechanical pencil shown in FIG. 18. In this case, heat is applied to the thermosetting film tube 41 after the tightening member receiver 6 and the rear holder 7 are inserted into the film tube 41 at a position shown in FIG. 26. As a result, the film tube 41 is fixedly connected to the tightening member receiver 6 and to the rear holder 7, thereby forming these components as one unit.

Other than described above, various arrangement or change of the components may be applied within the scope of the present invention. For example, some components or parts may be formed as one unit.

As is apparent from the above description, the invention has the following effects or merits:

The mechanical pencil having an automatic lead extending mechanism according to the present invention can perform a so-called "turning and writing" operation.

Further, in the mechanical pencil of the invention, the lead is protruded from a tip end of the pencil body during the writing.

Furthermore, according to the present invention, the lead can be extended with a relatively weak pinching force applied to the pencil body, that is, the radially displaceable member without changing the position of the fingers holding the pencil body.

Moreover, the mechanical pencil of the invention can be assembled with small the numbers of components and requires no special techniques in manufacturing.

Further, the mechanical pencil of the invention is good in design.

What is claimed is:

1. A mechanical pencil for writing with a lead, comprising:

a hollow body consisting of first and second longitudinally spaced parts;

an inner mechanism for clamping, extending and releasing the lead, said inner mechanism comprising a chuck, a tightening member engageable with said chuck, a lead holding member holding the lead with a predetermined holding force and a spring, said inner mechanism being accommodated in said first part of said hollow body;

a longitudinally extending and substantially inextensible radially displaceable means provided entirely on an outer circumference of said hollow body, said radially displaceable means being substantially circular in cross section, said radially displaceable means being linked at one end thereof to said inner mechanism and connected at the other end to said second part of said body, said radially displaceable means being readily radially displaceable in a radial direction with respect to said hollow body and formed of a material which is durable under varying atmospheric condition such as temperature and humidity, and mechanically durable, the longitudinal distance between said first and second longitudinally spaced parts and the longitudinal length of said radially displaceable means being shortened when said radially displaceable means is radially displaced in said radial direction, whereby said inner mechanism protrudes the lead from an end of said body in accordance with the radial displacement of said radially displaceable means.

2. The mechanical pencil of claim 1, wherein said inner mechanism clamps the lead when the pinching force is applied to said radially displaceable means, extends and subsequently releases the lead when the pinching force is released.

3. The mechanical pencil of claim 1, wherein said inner mechanism extends and subsequently releases the lead when the pinching force is applied to said radially displaceable means, and clamps the lead when the pinching force is released.

4. The mechanical pencil of claim 3, further comprising a holding portion provided adjacent to said radially displaceable means, said holding portion being held by fingers during writing.

5. The mechanical pencil of claim 1, wherein said radially displaceable means comprises fishing line.

6. The mechanical pencil of claim 1, wherein said radially displaceable means is formed of a flexible cloth.

7. The mechanical pencil of claim 1, wherein said radially displaceable means is a cylinder formed of a synthetic resin.

8. The mechanical pencil of claim 1, wherein said radially displaceable means is formed of a cellophane film tube.

9. The mechanical pencil of claim 1, wherein said radially displaceable means is formed of a thermosetting film tube.

10. The mechanical pencil of claim 2, further comprising:

a mouth ring containing therein said chuck and said tightening member;

a rear holder;

a sliding member slidable with said mouth ring, said sliding member being connected to an end of said radially displaceable means;

a tightening member receiver fixedly secured to said mouth ring therein, said receiver having a cylindrical end portion, an end of which is connected to said rear holder;

an annular ring connected to said rear holder, said ring being connected to the other end of said radially displaceable means;

a lead casing accommodated in said rear holder, said lead casing containing therein space lead;

a spring urging said lead casing longitudinally against said rear holder; and a connecting pipe inserted in said cylindrical end portion of said tightening member receiver, said connecting pipe connecting a rear end of said chuck to a front end of said lead casing, wherein said sliding member, said lead casing, said connecting pipe, and said chuck move rearwardly relative to said tightening member and said rear holder in accordance with the radial displacement of said radially displaceable means so as to clamp the lead.

11. The mechanical pencil of claim 3, further comprising:

a conical mouth ring disposed at a front end of said body;

a hollow rear holder containing therein spare leads;

a ring member having a flange portion engaged with said mouth ring, said ring having a coupling portion fixed to said rear holder, a part of said flange portion of said ring member being connected with a first end of said radially displaceable means;

a cylindrical member slidably inserted into said ring member, said cylindrical member being provided with at least one corner extending outwardly, an end of said corner of said cylindrical member being connected with: a second end of said radially displaceable means; and a lead holding member fitted in said cylindrical member at a front end thereof front side of said chuck, said lead holding member holding the lead with a predetermined, relatively weak holding force, wherein said chuck connects to said rear holder said tightening member moves in said cylindrical member at a predetermined distance, and said spring of said inner mechanism is disposed between said ring member and said cylindrical member.

12. The mechanical pencil of claim 3, further comprising:

a hollow mouth ring provided at a front of said body, said mouth ring being connected to a first end of said radially displaceable means;

a hollow rear holder accommodating therein spare leads, said rear holder being connected with a second end of said radially displaceable means at a front end thereof; and a tightening member receiver disposed in said mouth ring, said tightening member receiver containing therein said chuck and said tightening member being slidable a predetermined distance, wherein a rear end of said chuck connects to said rear holder, and said lead holder member is fitted in said mouth ring at a front end thereof.

13. The mechanical pencil of claim 12, wherein said spring is disposed between said tightening member receiver and said rear holder.

14. The mechanical pencil of claim 12, further comprising a lead casing inserted in said rear holder, wherein said chuck is connected to said lead casing, and said spring is disposed between said rear holder and said lead casing.

15. The mechanical pencil of claim 12, further comprising a braker disposed on an outer circumference of said chuck and a washer provided on a rear side of said braker, wherein said spring is disposed between said washer and said rear holder.

16. The mechanical pencil of claim 15, wherein said braker is an O-ring formed of an elastic material such as a rubber.

17. The mechanical pencil of claim 4, wherein a first end of said radially displaceable means is connected to said holding portion, said holding portion having a center hollow to which a pipe is fixedly fitted.

18. The mechanical pencil of claim 17, wherein said spring is interposed between said pipe and said rear holder.

19. The mechanical pencil of claim 18, further comprising a spring retainer fixed to said pipe, wherein said spring is interposed between said retainer and said rear holder.

20. The mechanical pencil of claim 17, further comprising a slide cylinder connected to a second end of said radially displaceable means, said slide cylinder being slidable on said rear holder.

21. The mechanical pencil of claim 1, wherein said radially displaceable means is wrapped by a rubber cylinder.

22. The mechanical pencil of claim 4, wherein said holding portion is provided with grooves on an entire periphery thereof.

23. A mechanical pencil for writing with a lead, comprising:

a hollow body consisting of first and second longitudinally spaced parts;

a cylindrical, longitudinally extending and substantially inextensible radially displaceable means disposed on an entire circumference of said body, said radially displaceable means being connected to said body, said radially displaceable means being readily radially displaceable in a radial direction with respect to said hollow body and formed of a material which is durable under varying atmospheric conditions and mechanically durable, the longitudinal distance between said first and second longitudinally spaced parts and the longitudinal length of said radially displaceable means being shortened when said radially displaceable means is radially displaced in said radial direction; and means for operating the lead to protrude it from an end of said first end of said body, said lead operating means being operationally linked to said radially displaceable means, said lead operating means comprising a chuck for clamping the lead, a tightening member for engaging with said chuck, a lead holding member for holding the lead with a predetermined force, and a spring.

24. The mechanical pencil of claim 1, wherein said radially displaceable means comprises metal wire.

25. The mechanical pencil of claim 1, wherein said radially displaceable means comprises monofilament.

* * * * *